US005906203A

United States Patent [19]

Klockseth et al.

[11] Patent Number: 5,906,203

[45] Date of Patent: May 25, 1999

[54] BREATHING APPARATUS

[75] Inventors: Martinus Oliver Klockseth, Belrose; Bengt Yngve Roland Jervmo, Green Point; Goran Bertil Claes Berndtsson, Elanora Heights, all of Australia

[73] Assignee: Safety Equipment Sweden AB, Warriewood, NSW, Australia

[21] Appl. No.: 08/776,628

[22] PCT Filed: Aug. 1, 1995

[86] PCT No.: PCT/AU95/00468

§ 371 Date: Apr. 22, 1997

§ 102(e) Date: Apr. 22, 1997

[87] PCT Pub. No.: WO96/04043

PCT Pub. Date: Feb. 15, 1996

[30] Foreign Application Priority Data

| | | | |
|---|---|---|---|
| Aug. 1, 1994 | [AU] | Australia | PN 7190 |
| Mar. 23, 1995 | [AU] | Australia | PN 1909 |
| Mar. 23, 1995 | [AU] | Australia | PN 1911 |
| May 22, 1995 | [AU] | Australia | PN 3106 |

[51] Int. Cl.[6] ..... A62B 7/10

[52] U.S. Cl. ..... 128/205.24; 128/205.12; 128/204.18; 128/201.25

[58] Field of Search ..... 128/205.24, 205.25, 128/205.27, 201.25, 204.21, 204.23, 205.23, 204.18, 205.12

[56] References Cited

U.S. PATENT DOCUMENTS

| | | | |
|---|---|---|---|
| 3,435,839 | 4/1969 | Elder . | |
| 4,331,141 | 5/1982 | Pokhis | 128/205.25 |
| 4,590,951 | 5/1986 | O'Connor | 128/201.25 |
| 4,676,236 | 6/1987 | Piorkowski et al. | 128/201.25 |
| 4,873,970 | 10/1989 | Freidank et al. | 128/205.27 |
| 5,372,130 | 12/1994 | Stern et al. | 128/205.25 |
| 5,540,218 | 7/1996 | Jones et al. | 128/205.24 |
| 5,577,496 | 11/1996 | Blackwood et al. | 128/201.25 |
| 5,749,359 | 5/1998 | Hansen | 128/205.25 |

FOREIGN PATENT DOCUMENTS

| | | | |
|---|---|---|---|
| 30964/89 | 9/1990 | Australia | 128/205.25 |
| 4202025 | 7/1993 | Germany | 128/201.25 |
| 2221164 | 1/1990 | United Kingdom | 128/201.25 |
| 2266247 | 10/1993 | United Kingdom | 128/201.25 |

*Primary Examiner*—John G. Weiss
*Assistant Examiner*—Virendra Srivastava
*Attorney, Agent, or Firm*—Townsend and Townsend and Crew LLP

[57] ABSTRACT

A forced air breathing apparatus which includes a face piece (20*a*) for covering at least the nose or mouth of a wearer, a pump unit (10) arranged to supply air to a space within the face piece (20*a*), a filter (13) to filter air entering the face piece (20*a*) and valve means to control the flow of air from the pump unit (20) to the face piece (20*a*) during inhalation and from the face piece (20*a*) during exhalation. The pump unit (20) includes a fan (12) driven by an electric motor (11). The valve means includes an air inlet valve (19) and an air outlet valve (22), the air outlet valve (22) being maintained in a closed position during inhalation through the air inlet valve (19) by air pressure from the pump unit (20) and being opened by exhaled air. The exhaled air also acts to close the air inlet valve (19) and prevents the entry of exhaled air to the pump unit (20). The fan (12) is a centrifugal fan driven at a substantially constant speed. A valve (14) is provided on the air inlet side of the pump unit (10) and is arranged to close when a defined air pressure is present within the pump unit (10) downstream of the fan (12).

26 Claims, 7 Drawing Sheets

BREATHING APPARATUS

FIELD OF THE INVENTION

The present invention relates to a fan-forced positive pressure breathing apparatus of the kind in which filtered air is pumped to a face piece or mask covering at least the nose or mouth of the wearer, the air being pumped by means of a fan driven by an electric motor which is usually battery powered.

BACKGROUND ART

Breathing apparatus of the kind of which the present invention is concerned is well known and a variety of different constructions have been proposed and the advantages and disadvantages of such apparatus are discussed in many patent specifications. Among the requirements of a satisfactory apparatus are that it supplies adequate quantities of air when the user takes a deep breath which, testing shows, necessitates the supply of a substantially higher flow rate than normally anticipated. It is desirable to minimise power consumption by the motor driving the fan consistent with the requirements set out above to increase battery life.

It is also highly desirable that the air pressure within the face piece or mask is never allowed to fall below the ambient atmospheric pressure. If this happened air may be drawn into the space within the piece or mask drawing environmental contaminants into that space.

The present invention is directed to providing an alternative form of forced air breathing apparatus that, at least in preferred embodiments, allows these desired ends to be achieved.

SUMMARY OF THE INVENTION

In a first aspect the present invention consists in a forced air breathing apparatus comprising a face piece or mask covering at least the nose or mouth of a wearer, a pump unit arranged to supply air to a space within the face piece or mask, an electric motor within the pump unit arranged to drive a fan forming part of the pump unit, a filter to filter air entering the face piece or mask and a valve means controlling the flow of air from the pump unit to the face piece or mask during inhalation and from the face piece or mask during exhalation, the valve means including an air inlet valve and an air outlet valve, the air outlet valve being maintained in a closed position during inhalation through the air inlet valve by air pressure from the pump unit and being opened by exhaled air which also acts on the inlet valve to prevent the entry of exhaled air to the pump unit.

It has been found that it is desirable to control the speed of the motor driving the fan so that it runs at a substantially constant speed. This is in contrast to previous proposals which have required the speed of the fan to be accelerated when more air flow is required. It has been found that operating at constant speed results in a saving of power consumed as compared with letting the fan slow down and then speeding it up again.

In a second aspect the present invention therefore consists in a forced air breathing apparatus comprising a face piece or mask for covering at least the nose or mouth of a wearer, a pump unit arranged to supply air to a space within the face piece or mask, an electric motor within the pump unit arranged to drive a centrifugal fan, means for monitoring and controlling the speed of the motor so that the fan rotates at a substantially constant speed during its operation, a filter to filter air entering the face piece or mask and a valve controlling exhalation of air from the face piece or mask by a user.

It has also been found that the functioning of such apparatus can be improved by the provision of a valve controlling the inlet of air to the pump unit, the valve being arranged upstream or downstream of the fan and being arranged to close when a defined air pressure is present within the pump unit. With apparatus according to this third aspect of the invention it is easier to ensure that there shall always be a positive pressure within the face piece or mask at all times thus avoiding the existence of the negative pressure which could give rise to the entry of contaminated air.

In a third aspect the present invention therefore consists in a forced air breathing apparatus comprising a face piece or mask for covering at least the nose or mouth of a wearer, a pump unit arranged to supply air to a space within the face piece or masks, an electric motor within the pump unit arranged to drive a fan forming part of the pump unit, and a valve controlling exhalation of air from the face piece or mask by a user, the apparatus including a valve controlling the flow of air through the pump unit, the valve being arranged to close when the pressure present within the breathing apparatus downstream of the fan rises to a predetermined level.

The term face piece or mask is taken to include any device covering the nose or mouth of a wearer and adapted to engage with the wearer's body or clothing around its edges. It may cover only the mouth or the nose or both of them. If desired, it may comprise a helmet covering the whole of the wearer's head.

As used in this specification, the term filter is taken to include any device for the removal of particulate and/or gaseous contaminants from the inhaled air. The particulates may be solid, as in smoke, or liquid, as in insecticide sprays. The filter may be adapted to remove gaseous contaminants, in which case the filter may be in the form of activated carbon or another gaseous absorbent.

The apparatus according to this invention may include, downstream of the filter, a device for measuring the oxygen content of the inhaled air. This device will preferably provide a warning to a wearer when the oxygen content of the filtered inhaled air falls below a predetermined level. In a particularly preferred embodiment of the invention, the apparatus includes a source of compressed oxygen or other breathable gas that can be released into the inhaled air at a rate sufficient to maintain the oxygen content of the inhaled air above that predetermined level.

For different applications of the breathing apparatus, different filter types are employed. Each different type of filter alters the apparatus flow resistance. The demands placed on the breathing apparatus will also vary with each filter type as a filter is progressively used. It has been found that calibrating the apparatus prior to use such that the speed and rotation of the fan are set at an optimum base value results in a saving of power and an increase in filter life.

In a fourth aspect, the present invention consists in a positive air pressure respirator apparatus comprising a face piece or mask covering at least the mouth or nose of a wearer, a pump unit arranged to supply air to the space within the face piece or mask, an electric motor within the pump unit arranged to drive a fan, wherein the apparatus is provided with actuable control means adapted to cause the apparatus to undergo a calibration phase such that the speed of rotation of the fan is set at a predetermined optimum base value relative to the operating conditions then prevailing in the apparatus. The base value is preferably maintained substantially constant during any one period of operation of the apparatus or until the apparatus is recalibrated.

In a preferred embodiment, the apparatus includes an electronic data processing means which monitors and controls the speed of the motor so as to ensure adequate air flow at the mask of the apparatus.

Preferably, the actuable control means takes account of the filter type and/or flow resistance within the apparatus to set the optimum value of speed of rotation of the fan.

In one embodiment, the actuable control means would be manually operated by a user of the apparatus. In this embodiment, the actuable control means would include the electronic data processing means with the user entering parameters relevant to the filter type and/or the flow resistance so as to set the optimum speed of the fan prior to use.

In a second embodiment, the actuable control means would automatically set the apparatus to undergo a calibration phase. One means of automatic operation would involve the parameters of the filter type being coded onto the filter such that the details are detected by the electronic data processing means which automatically adjust the flow of air through the apparatus. The transmission of the coded information to the electronic data processing means could be by optical, electrical or magnetic transfer.

A second and more desirable means of automatic operation would involve use of a pressure sensor and/or flow measurement apparatus, each under the control of the electronic data processing means. The pressure sensor and/or flow meter would preferably be located proximate, and downstream of, the filter of the apparatus such that flow and pressure drop are automatically measured with detected values of air flow and pressure being fed to the electronic data processing unit. The electronic data processing unit would then automatically calculate the appropriate speed of rotation of the fan given the measured parameters.

In one embodiment, the pressure sensor comprises a silicone pressure transducer. In a preferred embodiment, the pressure sensor comprises a flexible membrane arranged to flex with changes in pressure, an ultrasound transmitter arranged to direct ultrasound at the membrane, an ultrasound receiver arranged to detect ultrasound reflected from the membrane, and an analyzing means, the analyzing means being capable of determining a parameter based on the transit time of the ultrasound between the transmitter, membrane and receiver and calibrated so as to provide an indication of air pressure to the electronic data processing means.

To compensate for changes in the transit time of the ultrasound between the transmitter, membrane and receiver caused by temperature variations, there is preferably located proximate the pressure sensor a temperature probe in communication with the analyzing means, the analyzing means applying a compensation algorithm to the transit time in accordance with the measured temperature.

In another embodiment, the flow measurement apparatus comprises an air flow restrictor such as an orifice plate or mesh and a pressure sensor adapted to measure the change in pressure across the restrictor.

In another embodiment, the flow measurement apparatus comprises a pressure sensor adapted to measure the change in pressure between the pump unit and the face piece or mask resulting from one or more air flow restrictors between the pump unit and mask. The air flow restrictor preferably comprises an air transfer hose which allows flow of air between the pump unit and face piece or mask.

In a further embodiment, the flow measurement apparatus comprises an ultrasound transmitter and an ultrasound receiver adapted to respectively transmit and detect ultrasound travelling along a portion of the air transfer hose. The flow rate is directly proportional to the time shift of the ultrasound travelling down the hose. One advantage of this method is that it places no flow restrictions on the air flow in the apparatus.

In a still further embodiment, the flow measurement apparatus comprises a thermistor placed in the air flow and heated to a temperature greater than ambient temperature, the flow rate being proportional to the cooling effect of the air flow on the heated thermistor.

Due to hygienic and safety reasons, the mask is preferably washed after each use. For these reasons it is not desirable to have electrical systems, or other apparatus vulnerable to breakage, in the mask.

In a fifth aspect, the present invention consists in a positive air pressure respirator apparatus comprising a plurality of parts including a face piece or mask covering at least the mouth or nose of a wearer, a pump unit arranged to supply air to the space within the face piece or mask, an electric motor within the pump unit arranged to drive a fan, at least one filter to filter air entering the face piece or mask, and a performance monitoring means for some or all of the parts which provides at least one signal that informs the wearer of the condition of some or all of the parts, wherein the signal is generated externally to the face piece or mask and is fed to the face piece or mask for detection by a wearer.

Preferably, the performance monitoring means in one embodiment includes a pressure transducer which detects the air pressure within the apparatus, the pressure transducer being preferably located proximate the fan. The output from the pressure transducer is preferably fed to an electronic data processing unit within the performance monitoring means. Should the air pressure fall below a pre-set safe minimum level, at least one warning signal is generated by the electronic data processing unit for detection by the wearer.

In another embodiment, the performance monitoring means monitors the condition of the power source, the filter and/or the fan/motor unit. The power source preferably comprises a rechargeable battery. Should battery charge, as measured by a voltmeter, fall below a pre-set safe level for operation of the apparatus, the electronic data processing unit preferably detects this occurrence and generates a warning signal for detection by the wearer. Filter condition is preferably monitored by an air flow meter/pressure transducer that monitors the flow resistance of the filter. Should the resistance exceed a pre-set safe maximum level, the electronic data processing unit detects this occurrence and generates a warning signal for detection by the wearer. Fan/motor unit condition is preferably monitored by an air flow/pressure transducer and a voltage/current transducer that monitors the performance rate of the fan/motor unit. Should the performance rate fall below a pre-set safe minimum level, the electronic data processing unit detects this occurrence and generates a warning signal for detection by the wearer.

The warning signal is preferably a light source and/or audible tone. The light source is preferably a light emitting diode (LED). The light from the light emitting diode is preferably transmitted to the face piece or mask by optical fiber. The optical fiber is preferably connected to the mask with a fitting which allows straightforward detachment of the optical fiber from the mask.

The audible tone is preferably transmitted to the face piece or mask by an air hose serving as a sound pipe. The air hose is also preferably detachable from the head piece, face piece or mask.

In a further embodiment, the fan unit of the respirator apparatus includes a pressure transducer. The pressure transducer is preferably in communication with the space within the head piece, face piece or mask via at least one hose so as to allow measurement of the pressure in the space within the face piece or mask.

Preferably, the apparatus is arranged so as to allow measurement of pressure at a number of locations within the apparatus. Preferably, a plurality of hoses from different parts of the apparatus are in communication with the pressure transducer with the electronic data processing unit controlling from which location the pressure measurement is being taken at any one time. In one embodiment, one hose is connected to a reference port, preferably atmospheric pressure, with the values of pressure for other locations measured as a ratio of the pressure measured at the reference port.

Ready removal of the optical fiber, pressure communication hoses and/or air hoses from the mask ensures easy cleaning of the mask prior to and/or after use.

The positive air pressure breathing apparatus according to this invention preferably operates at a low pressure but at a relatively high flow rate. In preferred embodiments the apparatus is capable of delivering at least 150 liters of air per minute, preferably 300 liters of air per minute, and more preferably at least 500 liters of air per minute, to a wearer. In preferred embodiments the supply pressure of air to the air inlet valve admitting air to the face piece or mask is between zero and 10 mBar, more preferably no more than 6 mBar, above ambient reference pressure. It is also preferred that the fan in the pump unit produces a pressure in this range. It is possible, however, to provide a regulator between a pump unit producing air at a higher pressure and the value means associated with the face piece or mask. In this case the pump unit will supply air at a pressure of less than 1 Bar, preferably less than 100 mBar, and more preferably less than 20 mBar. At these low pressures hose diameters must be so chosen as to avoid undue flow restrictions that would cause large pressure drops in the system.

BRIEF DESCRIPTION OF THE DRAWINGS

In order that the nature of the invention may be better understood, preferred forms thereof are hereinafter described by way of example with reference to the accompanying diagrammatic drawings, in which.

DESCRIPTION OF THE SPECIFIC EMBODIMENTS

Figure 1:
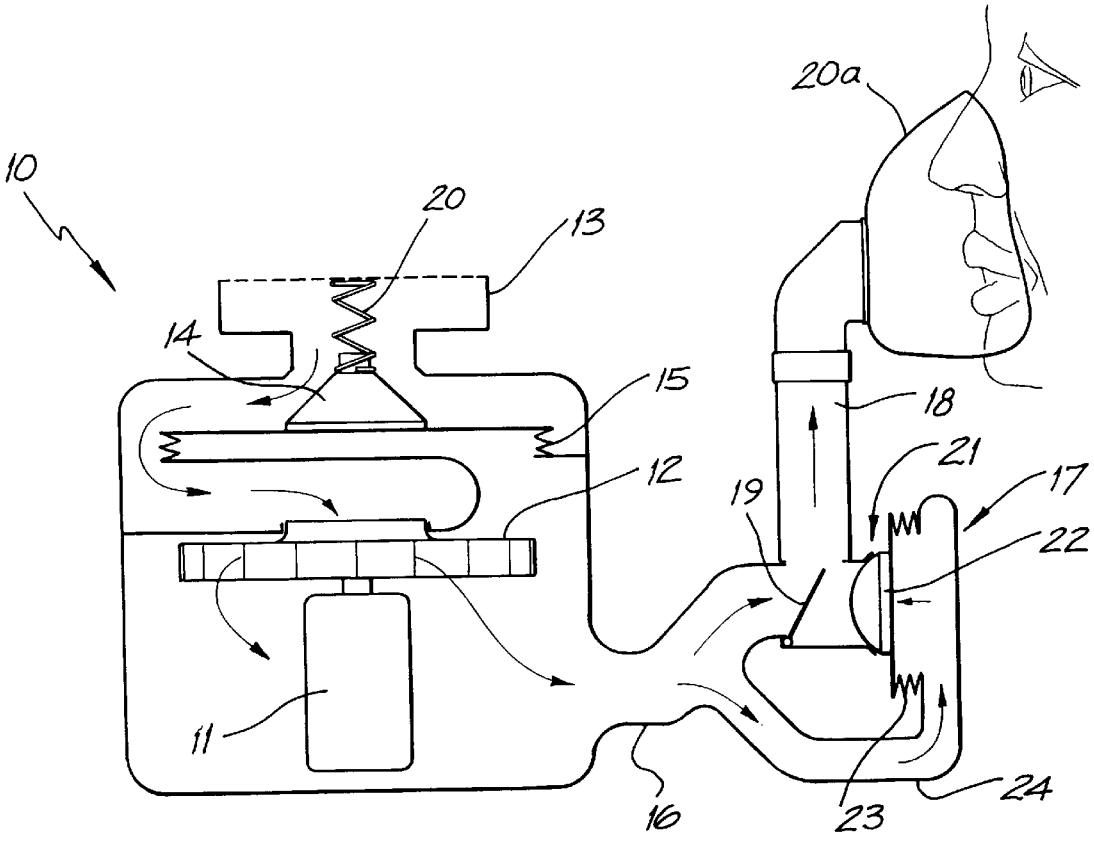
FIG. 1 is a diagrammatic drawing of those parts of the apparatus with which the present invention is concerned, in the configuration adopted during the period in which air is being inhaled by the user.
Figure 2:
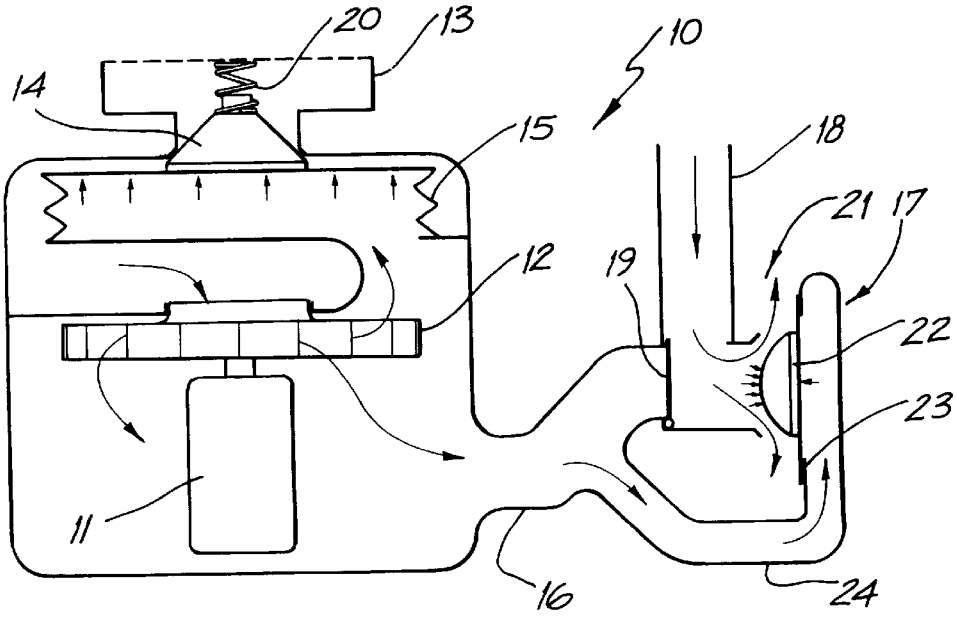
FIG. 2 is a view similar to FIG. 1 showing the apparatus in the configuration adopted when air is being exhaled by the user.

The apparatus shown in FIGS. 1 and 2 consists of a pump unit 10 enclosing an air space and an electric motor 11 driving a centrifugal fan 12. In addition to the parts shown there is a source of power for the motor, usually a rechargeable battery, and in addition a motor speed control unit of conventional construction. This unit monitors the speed of rotation of the fan 12 and controls the speed of the motor to cause it to operate at a substantially constant speed irrespective of whether air is being inhaled or exhaled by the user.

Air is drawn into the pump unit 10 through a conventional filter 13. The entry of air from the filter is controlled by the valve member 14 associated with the bellows 15 which closes the valve during exhalation of air as shown in FIG. 2 and which is lightly biased to the open position by means of the spring 20 as shown in FIG. 1. During the inhalation of air as illustrated in FIG. 1 the valve 14 is displaced by the spring 15 and the depression within the pump unit to allow air to enter the pump unit.

Means may be provided for adjusting the pressure at which the valve 14 closes. It is desirable to keep this as low as possible and for the valve to be arranged to open only for a time sufficient to allow the required amount of air to enter after which the valve closes. The system is balanced with the valve acting as a pressure regulator to minimize pressure fluctuations in the pump unit as much as possible to ensure a more or less instantaneous supply of air from the fan to the user as soon as inhalation commences.

The pump unit is connected by means of the duct 16 to an exhaust valve shown at 17. The duct 16 splits into two parts; a duct 18 which leads via a valve member 19 to the face piece or mask (20*a*) and also to an exhaust outlet 21 which during inhalation is closed by the valve member 22 which is lightly biased to the closed position by the spring 23 as shown in FIG. 1. In certain embodiments of the invention the valve 22 could be replaced by a simple spring loaded exhalation valve.

The second branch 24 of the duct 16 leads to the rear of the valve member 22 which tends to maintain the valve in a pressure balanced condition.

The flow of air during inhalation is illustrated by the arrows shown in FIG. 1. Air is drawn in through the open valve 14 to the fan 12 which generates a pressure to produce an air flow through the ducts 16 and 18 to the face piece or mask worn by the user. It will be seen that the valve 19 is maintained open by the air pressure on it and air flows freely to the user. The pressure of air in the duct 24 acts on the back of valve 22 to reinforce the action of the spring 23 and keep the valve closed.

The configuration of the apparatus during exhalation is shown in FIG. 2 in which the valve 14 is closed. The valve 19 is also closed due to exhalation of air by the user. The fan 12 which is maintained at a constant speed of rotation by the motor 11 is operating in a stalled condition and the pressure generated by it is not sufficient to open the valve 19 against the pressure of exhaled air. It does, however, apply pressure to the rear of the valve 22 but at a lower level than the exhalation pressure, thus allowing the valve 22 to be held open. Exhaled air can escape from the exhaust opening 21.

Whereas the apparatus is shown in a purely diagrammatic manner in FIGS. 1 and 2, FIGS. 3 and 4 show in a more realistic manner one form of exhaust valve construction corresponding in function to the exhaust valve 17 shown in FIGS. 1 and 2. In this construction the duct 25 corresponds to the duct 16 in FIGS. 1 and 2, a pair of one-way valves 26 correspond to the valve member 19 of FIGS. 1 and 2, and a pair of outlet apertures 27 correspond to the duct 18 of FIGS. 1 and 2 providing a connection to the face piece or mask. Thus, during inhalation, air from the pump unit enters the duct 25, passes through the valve 26 and is supplied to the face piece or mask through the outlet 27.

Within the center of the outlet valve is a diaphragm valve 28 lightly loaded by a spring 29 onto a seating 31. This valve has a central hollow stem 32 movable with the diaphragm. This has air inlet apertures 33 at its lower end and an air outlet 34 at its upper end. The diaphragm valve 28 corresponds to the valve 22 of FIGS. 1 and 2.

During exhalation air enters through the air inlets 27. The exhaled air exercises pressure on the diaphragm valve 28 and causes it to open against the spring 29. Air then passes the diaphragm of valve 28 and vents to atmosphere through the one-way valves 35 at the top of the casing. The valves 35 which prevent the ingress of contaminated air in the event of fan failure are not absolutely essential to the operation of the system and may be omitted.

Figure 3:
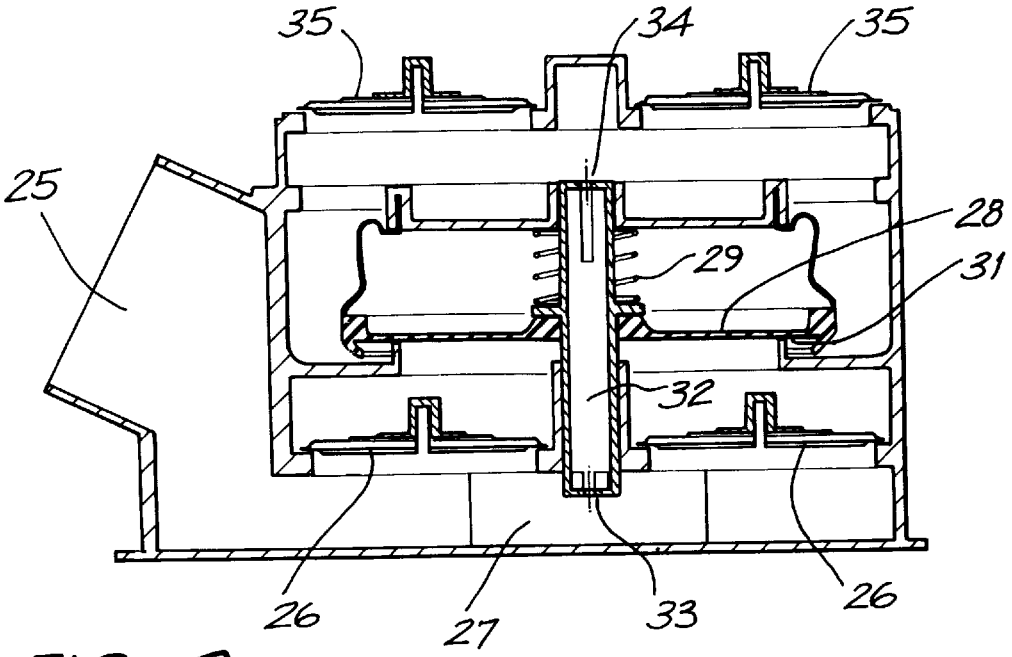
FIG. 3 is a view in cross-section of one form of exhaust valve according to the invention.
Figure 4:
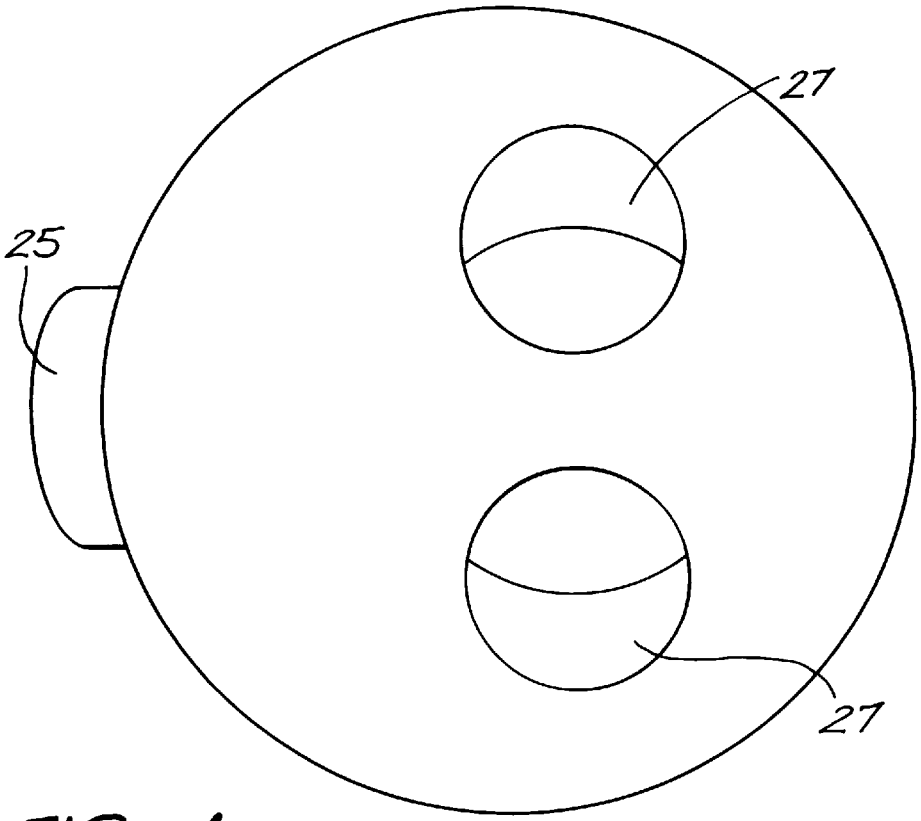
FIG. 4 is a plan view from below of the valve shown in FIG. 3.

The exhaust valve shown in FIGS. 3 and 4 has features not shown in FIGS. 1 and 2 in that when the hollow stem 32 is in the position shown in FIG. 3, air under pressure from the pump unit can enter the apertures 33 and exert pressure on the upper surface of the diaphragm valve 28, reinforcing the action of the spring 29, and the situation is similar to that shown in FIGS. 1 and 2. Once, however, the diaphragm 28 moves upwardly it carries the member 32 with it. This has the effect of shutting off the air inlets 33 and opening the air outlet 34 thus releasing any air pressure above the diaphragm 28 through the one-way valves 35.

Figures 5A, 5B, 5C:
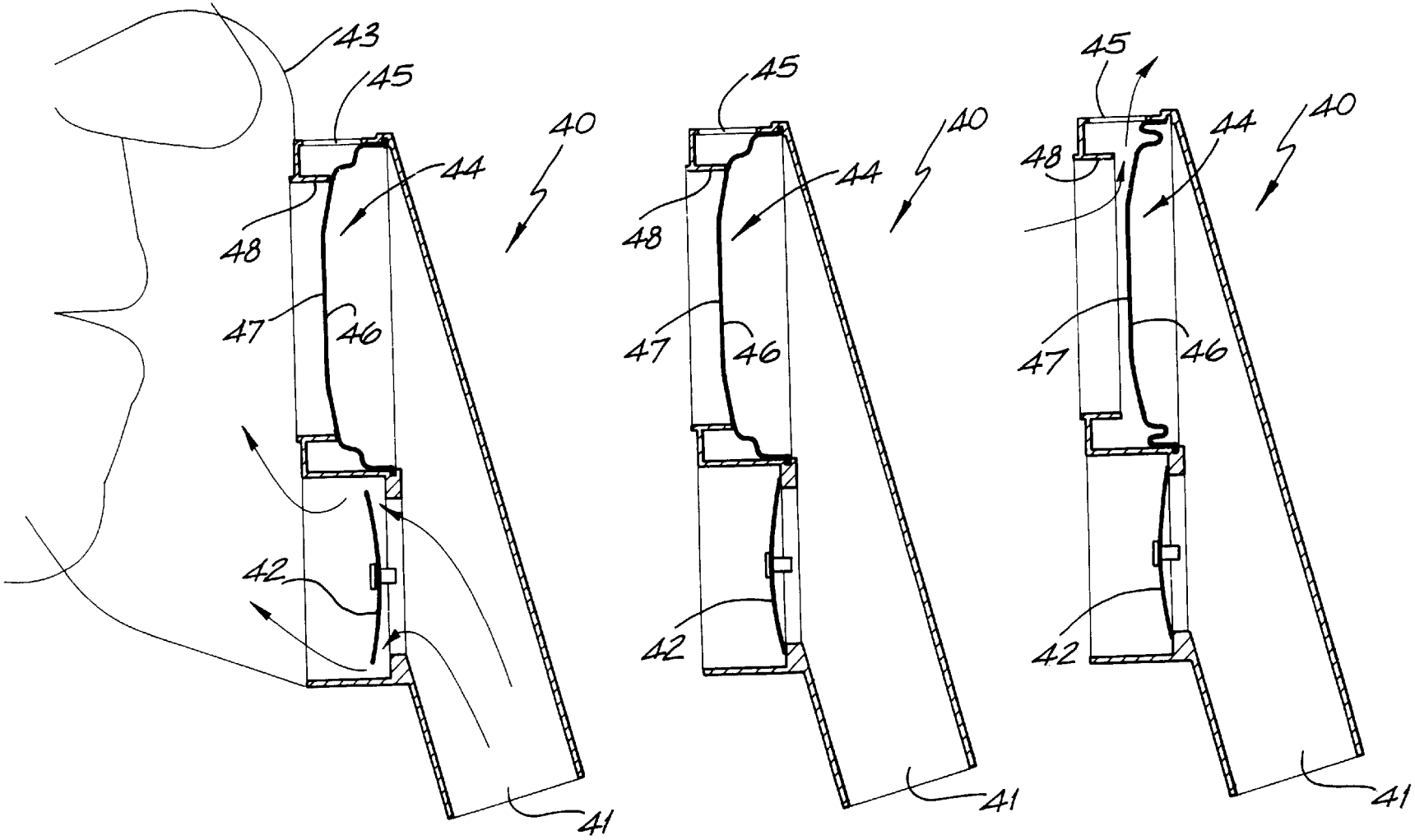
FIG. 5 is a view in cross-section through another form of exhaust valve according to the invention, FIG. 5(*a*) showing the valve during inhalation, FIG. 5(*b*) showing the valve in a stable closed condition, and FIG. 5(*c*) showing the valve during exhalation.

The valve 40 includes an air inlet duct 41 connected to a source of positive air pressure (not shown), a first valve 42, a face mask 43 covering the mouth and nose of a wearer (as is shown in FIG. 5(*a*)), a second valve 44, and a discharge aperture 45 for the discharge of exhaled air to atmosphere.

The first valve 42 serves to admit air from the inlet duct 41 into the face mask 43 when the system pressure in the inlet duct 41 exceeds the pressure in the face mask 43. When the pressures are equal the valve 42 closes.

The second valve 44 serves to permit the passage of exhaled air from the face mask 43 through the discharge aperture 45 to atmosphere. The valve 44 comprises a diaphragm which is exposed on a first face 46 to the inlet duct 41 and the air pressure therein. A second face 47 of the diaphragm of valve 44 is arranged to bear against a valve seat 48 for the second valve 44. The area of the second face 47 of the diaphragm within the area defined by value seat 48 is exposed, when the valve is closed, to the pressure within the face mask 43. The remainder of the second face 47 of the diaphragm will be exposed to atmospheric pressure through discharge aperture 45 when the valve 44 is closed.

In operation air will flow from inlet duct 41 through valve 42 into the face mask 43 until it is equal in pressure to that in the inlet duct 41. The valve 42 will then close. If the wearer now exhales the pressure in the face mask 43 will rise. Once the rise is sufficient to overcome the force holding valve 44 in a closed position that valve will open and air will discharge from the face mask 43 through valve 44 and discharge aperture 45 to atmosphere.

The force holding the valve 44 in a closed position is the difference between the pressure on the first face 46 and the second face 47. As the pressure applied to the diaphragm from the inlet duct 41 and the face mask 43 will initially be equal, it can be seen that the force holding the valve 44 closed is the difference between atmospheric pressure on that part of the second face that lies outside the valve seat 48 and the inlet duct pressure over a similar area. As this area is small relative to the area of the diaphragm which lies within the area defined by valve seat 48, even a small rise in pressure within the face mask is sufficient to open the outlet valve 44. As the area is small even a substantial increase in system pressure within the inlet duct will not raise greatly the exhalation pressure required to open the second valve 44.

Figure 6C:
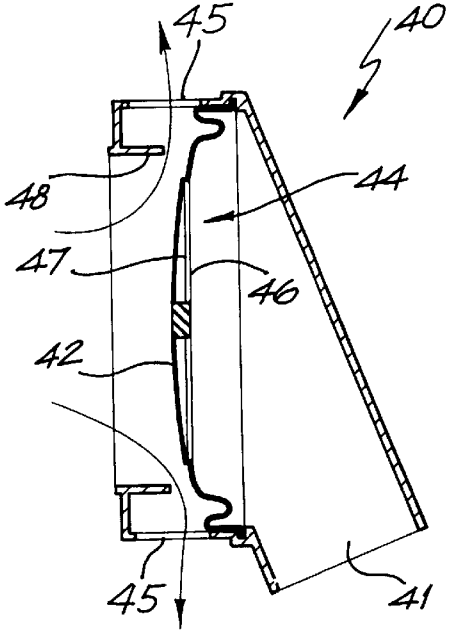
FIG. 6 is a view in cross-section through a further form of exhaust valve according to the invention, FIG. 6(*a*) showing the valve during inhalation, FIG. 6(*b*) showing the valve in a stable closed condition, and FIG. 6(*c*) showing the valve during exhalation.
Figure 6B:
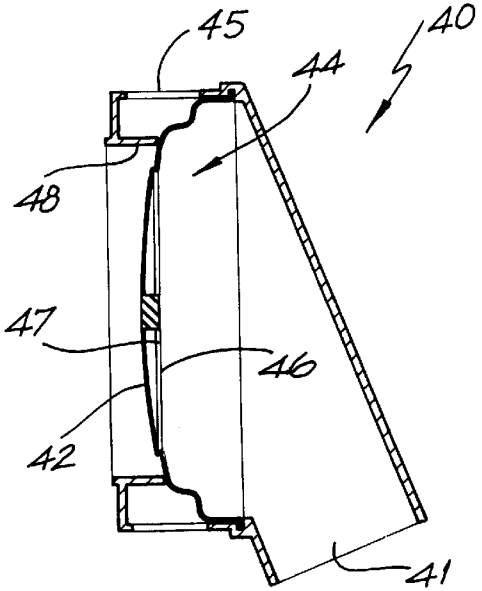
Figure 6A:
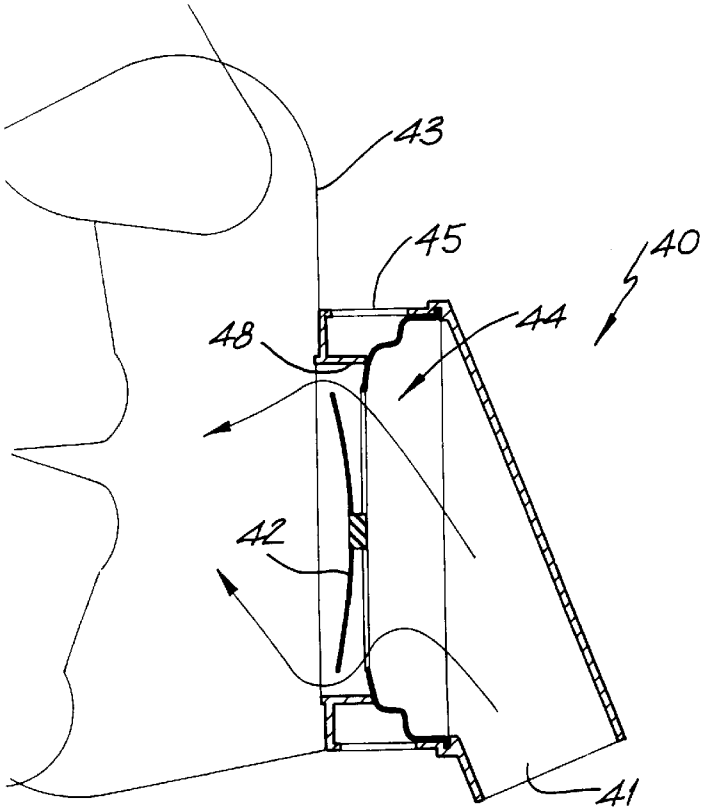

The arrangement shown in FIGS. 6(*a*) to 6(*c*) is essentially similar to that described with reference to FIGS. 5(*a*) to 5(*c*) and similar parts are given the same numeric designation. In this embodiment the first valve 42 is disposed within the membrane of the second valve 44. The valve works in the manner described with reference to FIGS. 5(*a*) to 5(*c*).

Figure 7A:
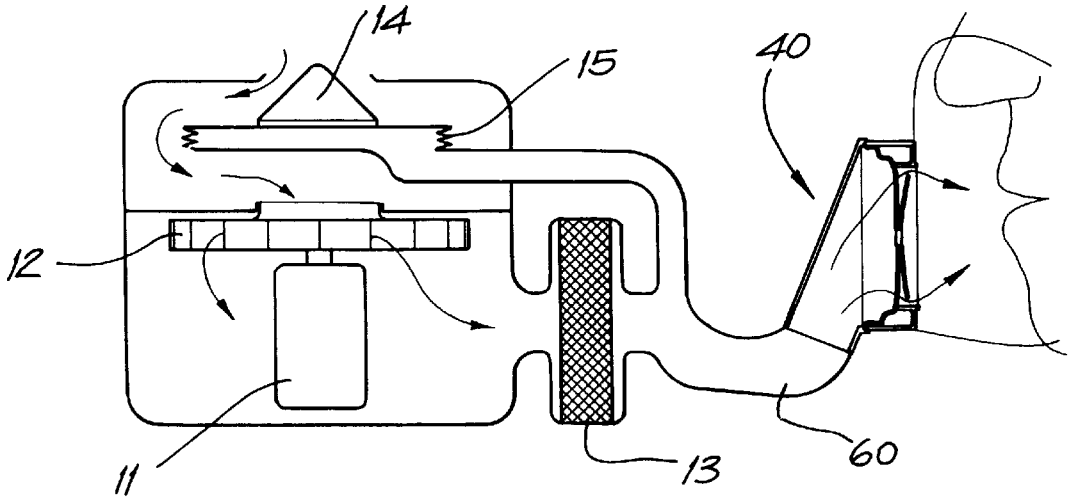
FIG. 7 is a diagrammatic drawing of a still further form of the apparatus with which the present invention is concerned, FIG. 7(*a*) showing the apparatus during inhalation, and FIG. 7(*b*) showing the apparatus during exhalation.
Figure 7B:
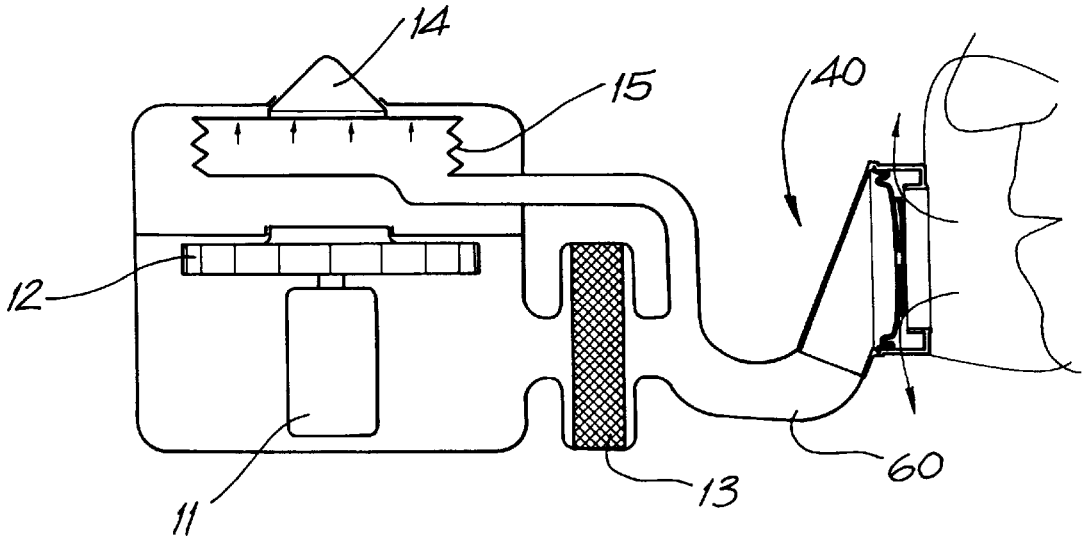

The arrangement shown in FIGS. 7(*a*) and 7(*b*) is similar to the arrangement described with reference to FIGS. 1 and 2 with two major exceptions. The first exception that the valve 40 of FIGS. 6(*a*) to 6(*c*) has been substituted for valve 17 of FIGS. 1 and 2. The second exception is that the filter 13 is moved from in front of the fan 12 to behind the fan 12. The pressure controlling the valve 14 is drawn from a duct 60 linking the filter 13 with the valve 40. In this way the opening and closing of the valve 14 more closely reflects the changes in pressure due to the breathing by a wearer due to inclusion of the pressure drop over the filter in the regulation.

Figure 8A:
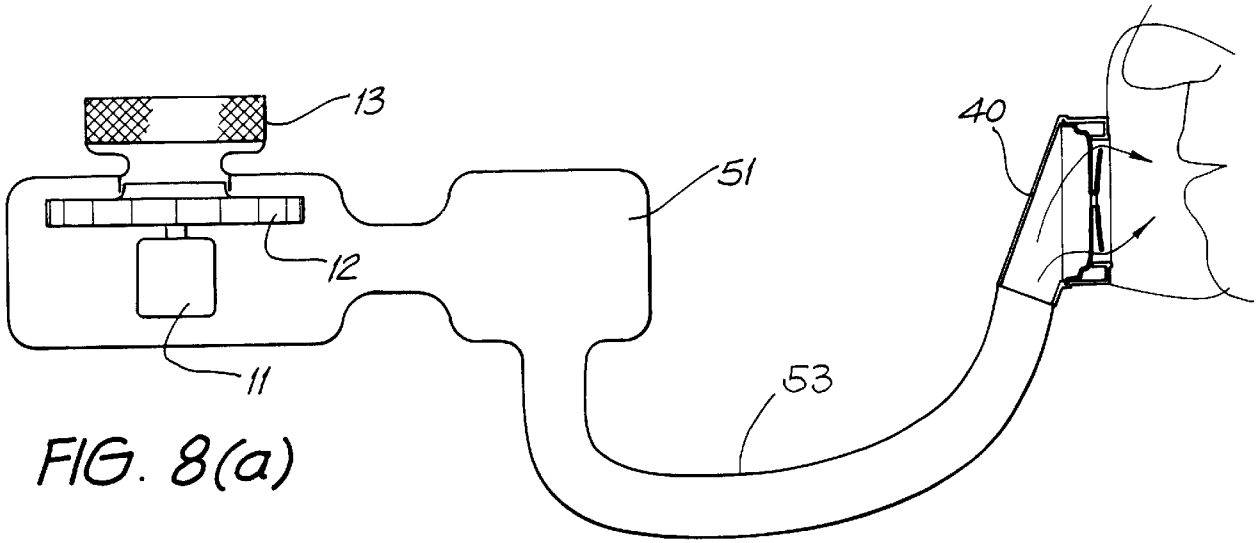
FIG. 8 is a diagrammatic drawing of yet another form of apparatus in which the present invention is concerned, FIG. 8(*a*) showing the apparatus during inhalation, and FIG. 8(*b*) showing the apparatus during exhalation.
Figure 8B:
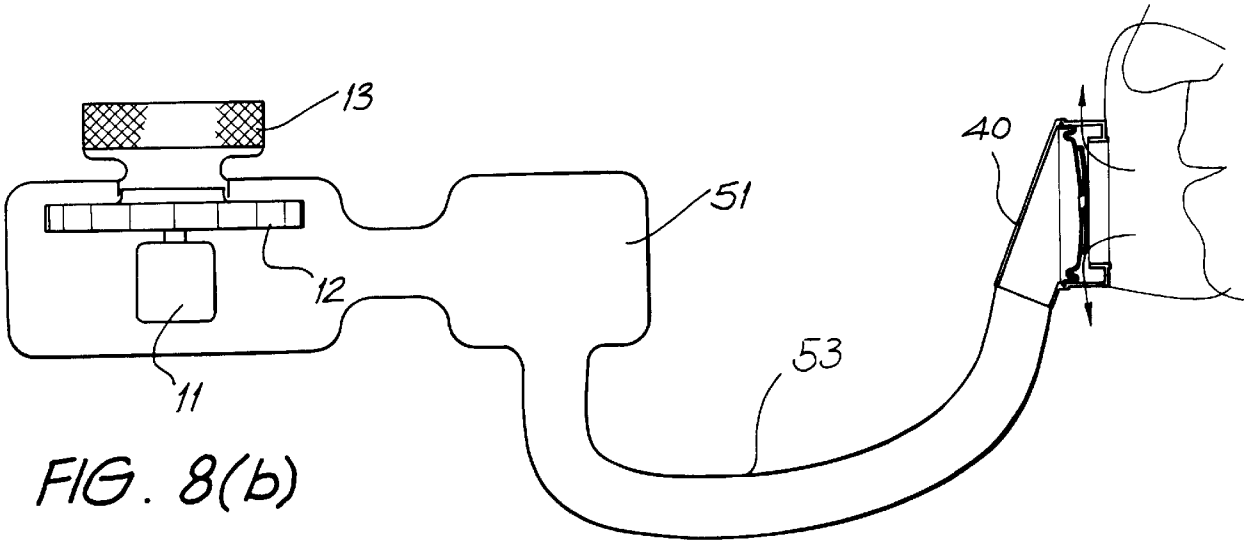

FIGS. 8(*a*) and 8(*b*) show fan-forced positive air pressure breathing apparatus according to this invention. The arrangement is similar to the arrangement described with reference to FIGS. 7(*a*) and 7(*b*) and similar parts are given the same numeric designation. In this case the fan operates at a high pressure and feeds high pressure air to a regulator 51. Air from the regulator 51 flows through hose 53 to valve 40.

Figure 9:
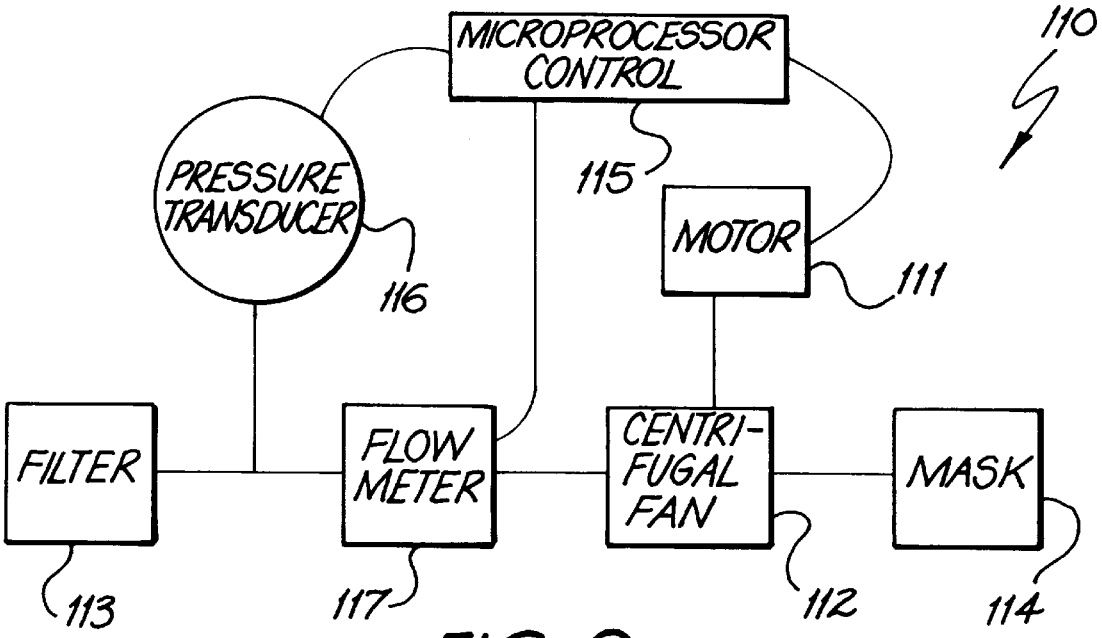
FIG. 9 is a schematic view of one embodiment of the respirator apparatus according to the fourth aspect of the present invention.

A positive air pressure respirator is generally shown as 110 in FIG. 9. The apparatus includes a pump unit in which is situated an electric motor 111 driving a centrifugal fan 112. In addition to the above parts shown there is a source of power for the motor 111, usually a rechargeable battery (not depicted), and a motor speed control unit under microprocessor control 115.

Air is drawn into the respirator 110 through a filter 113, passes through the fan 112 and exits the apparatus 110 via the mask 114. The mask 114 is adapted to completely cover the mouth and nose of a wearer and is adjustable so as to fit snugly to the contours of the face of the wearer.

The microprocessor control 115 in the embodiment depicted monitors input from a pressure transducer 116 and a flow meter 117 and is thereby able to ascertain the flow resistance of the filter 113 being employed. In those cases where flow resistance is high, the microprocessor control 115 will note this and set the speed of rotation of the fan 112 at a higher level to compensate, thereby ensuring that adequate flow of air is available at the mask 114 on inhalation by the wearer.

In operation, the microprocessor control 115 will automatically undertake a measure of flow resistance and automatically adjust the speed of the fan 112 to the necessary level.

Figure 10:
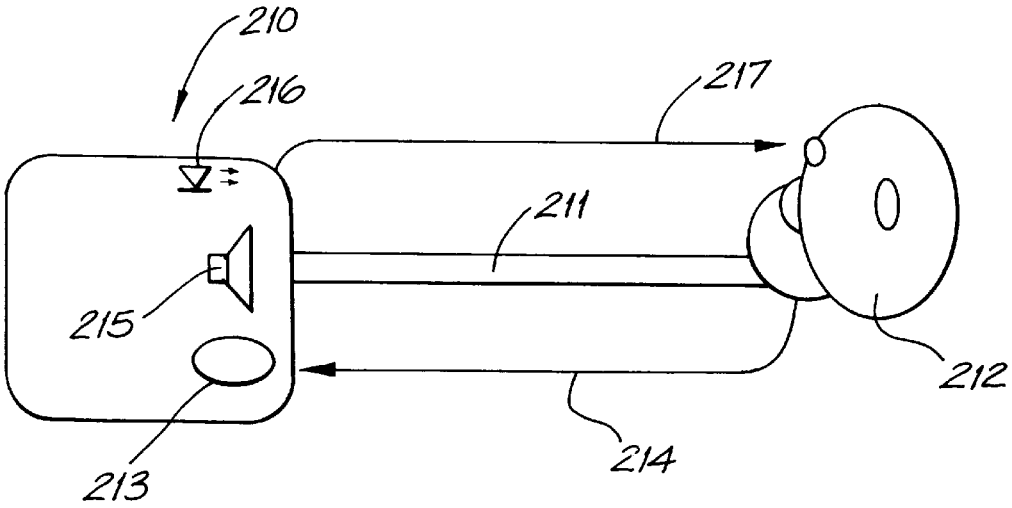
FIG. 10 is a schematic view of one embodiment of a user interface for a respirator apparatus according to the fifth aspect of the present invention.

A positive air purifying respirator is generally shown as 210 in FIG. 10. The apparatus includes a pump unit in which is situated an electric motor driving a centrifugal fan, a power source, usually a rechargeable battery, and a motor speed control unit under microprocessor control (all not depicted). Air is drawn into the respirator 210 through a filter, passes through the fan and exits the apparatus 210 through an air hose 211 and mask 212. The mask 212 is adapted to completely cover the mouth and nose of a wearer and is adjustable so as to fit snugly to the contours of the face of the wearer.

Performance of the apparatus 210 is monitored by a performance monitor located within the pump unit. The performance monitor controls a pressure transducer located proximate the fan, a flow meter located proximate the filter, a voltmeter monitoring the charge of the battery and a pressure transducer 213 located in the apparatus 210 which measures the pressure in the space within the mask 212. The pressure transducer 213 is in communication with the space within the mask 212 via a flexible hose 214. The hose 214 is preferably connected to the mask 212 with a fitting which allows ready removal of the hose 214 after use of the apparatus 210.

Should air pressure either at the fan or within the mask 212, air flow or battery charge fall below a pre-set low level, the performance monitor issues a warning signal to the wearer.

The warning signal comprises-both an audible tone and an indicator light. The audible tone is generated by a speaker 215 within the apparatus 210, with the tone transmitted through the air transfer hose 211 to the mask 212. The light source is generated by a light emitting diode (LED) 216 with the light transmitted to the field of view of the wearer in the mask 212 by an optical fiber 217.

Both the optical fiber 217 and air hose 211 are connected to the mask 212 by fittings which allow ready removal of these items from the mask 212 prior to it being cleaned.

We claim:

1. A forced air breathing apparatus comprising a face piece or mask covering at least the nose or mouth of a wearer, a pump unit arranged to supply air to a space within the face piece or mask, an electric motor within the pump unit arranged to drive a fan forming part of the pump unit, a filter to filter air entering the face piece or mask and a valve means controlling the flow of air from the pump unit to the face piece or mask during inhalation and from the face piece or mask during exhalation, the valve means including an air inlet valve and an air outlet valve, the air outlet valve being maintained in a closed position during inhalation through the air inlet valve by air pressure from the pump unit and being opened by exhaled air which also acts on the inlet valve to prevent the entry of exhaled air to the pump unit.

2. A forced air breathing apparatus as claimed in claim 1 in which the apparatus includes means for maintaining and controlling the speed of the motor so that the fan rotates at a substantially constant speed during its operation.

3. A forced air breathing apparatus as claimed in claim 2 in which the fan is a centrifugal fan.

4. A forced air breathing apparatus as claimed in claim 1 in which the apparatus includes a valve controlling the flow of air through the pump unit, the valve being arranged to close when the pressure present within the breathing apparatus downstream of the fan rises to a predetermined level.

5. A forced air breathing apparatus as claimed in claim 1 in which the apparatus is provided with actuable control means adapted to cause the apparatus to undergo a calibration phase such that the speed of rotation of the fan is set at a predetermined optimum base value relative to the operating conditions then prevailing in the apparatus.

6. A forced air breathing apparatus as claimed in claim 5 in which the actuable control means includes electronic data processing means which monitors and controls the speed of the motor so as to ensure adequate air flow at the face piece or mask of the apparatus.

7. A forced air breathing apparatus as claimed in claim 6 in which the electronic data processing means includes means to enable a user to enter into the electronic data processing means parameters relevant to the filter type and/or the flow resistance of the apparatus.

8. A forced air breathing apparatus as claimed in claim 6 in which the electronic data processing means includes means adapted to automatically read from the filter in the apparatus parameters relating to that filter.

9. A forced air breathing apparatus as claimed in claim 6 in which the electronic data processing means includes a pressure sensor and/or a flow measurement apparatus adapted to measure the pressure of air in the apparatus and the flow of air through the apparatus, preferably at a location proximate, and downstream of, the filter.

10. A forced air breathing apparatus as claimed in claim 9 in which the pressure sensor comprises a flexible membrane arranged to flex with changes in pressure, an ultrasound transmitter arranged to direct ultrasound at the membrane, an ultrasound receiver to detect ultrasound reflected from the membrane, and an analysing means, the analysing means being capable of determining a parameter based on the transit time of the ultrasound between the transmitter, the membrane and the receiver and calibrated so as to provide an indication of air pressure to the electronic data processing means.

11. A forced air breathing apparatus as claimed in claim 10 in which a temperature probe is included in the electronic data processing means and located proximate the pressure sensor, the temperature probe communicating to the analysing means a signal indicative of measured temperature to allow the analysing means to apply a compensating algorithm to the transit time in accordance with the measured temperature.

12. A forced air breathing apparatus as claimed in claim 1 in which the apparatus includes performance monitoring means for some or all of the parts of the apparatus, which means provides at least one signal that informs the wearer of the condition of some or all of the parts, the signal being generated externally at the face piece or mask and is fed to the face piece or mask for detection by a wearer.

13. A forced air breathing apparatus as claimed in claim 12 in which the performance monitoring means includes a pressure transducer which detects the air pressure within the apparatus, preferably proximate the fan.

14. A forced air breathing apparatus as claimed in claim 12 in which the performance monitoring means monitors the condition of at least one member of the group comprising the power source, the filter, or the pump unit.

15. A forced air breathing apparatus as claimed in claim 12 in which the warning signal is a light source, preferably a light emitting diode, which is transmitted to the face piece or mask by optical fibre.

16. A forced air breathing apparatus as claimed in claim 12 in which the warning signal is an audible tone transmitted to the face piece or mask by an air hose serving as a sound pipe.

17. A forced air breathing apparatus as claimed in claim 1 in which the apparatus is adapted to deliver at least 150 liters of air per minute, preferably at least 300 liters of air per minute, more preferably at least 500 liters of air per minute, to a wearer.

18. A forced air breathing apparatus as claimed in claim 1 in which the apparatus is adapted to supply air to the air inlet valve admitting air to the face piece or mask at a pressure between zero and 10 mBar, more preferably no more than 6 mBar, above ambient reference pressure.

19. A forced air breathing apparatus as claimed in claim 1 in which the filter is positioned between the pump unit and the face piece or mask.

20. A forced air breathing apparatus as claimed in claim 19 in which the apparatus includes a valve controlling the flow of air through the pump unit, the valve being arranged to close when the pressure present within the breathing apparatus between the filter and the face piece or mask rises to a predetermined level.

21. A forced air breathing apparatus as claimed in claim 1 in which the air outlet valve is in flow communication with the pump unit during inhalation and exhalation.

22. A forced air breathing apparatus as claimed in claim 1 in which the pump unit pumps air acting directly on the air outlet valve to maintain the air outlet valve in the closed position during inhalation.

23. A positive air pressure respirator apparatus comprising a face piece or mask covering at least the mouth or nose of a wearer, a pump unit arranged to supply air to the space within the face piece or mask, an electric motor within the pump unit arranged to drive a fan, wherein the apparatus is provided with actuable control means adapted to cause the apparatus to undergo a calibration phase such that the speed of rotation of the fan is set at a pre-determined optimum base value relative to the operating conditions then prevailing in the apparatus.

24. A positive air pressure respirator apparatus comprising a plurality of parts including a face piece or mask covering at least the mouth or nose of a wearer, a pump unit arranged to supply air to the space within the face piece or mask, an electric motor within the pump unit arranged to drive a fan, at least one filter to filter air entering the face piece or mask, a valve controlling the flow of air from the pump unit to the face piece or mask during inhalation and from the face piece or mask during exhalation, the valve including an air outlet valve which is maintained in a closed position during inhalation by air pressure from the pump unit, and a performance monitoring means for some or all of the parts which provides at least one signal that informs the wearer of the condition of some or all of the parts, wherein the signal is generated externally to the face piece or mask and is fed to the face piece or mask for detection by a wearer.

25. A forced air breathing apparatus comprising a face piece or mask for covering at least the nose or mouth of a wearer, a pump unit arranged to supply air to a space within the face piece or mask, an electric motor within the pump unit arranged to drive a centrifugal fan, means for monitoring and controlling the speed of the motor so that the fan rotates at a substantially constant speed during its operation, a filter to filter air entering the face piece or mask and a valve controlling exhalation of air from the face piece or mask by a user.

26. A forced air breathing apparatus comprising a face piece or mask for covering at least the nose or mouth of a wearer, a pump unit arranged to supply air to a space within the face piece or masks, an electric motor within the pump unit arranged to drive a fan forming part of the pump unit, and a first valve controlling exhalation of air from the face piece or mask by a user, the apparatus including a second valve controlling the flow of air through the pump unit, the second valve being arranged to close when the pressure present within the breathing apparatus downstream of the fan rises to a predetermined level.

* * * * *